US011459528B2

(12) United States Patent
Aksoy Abaci et al.

(10) Patent No.: US 11,459,528 B2
(45) Date of Patent: Oct. 4, 2022

(54) AUTOMATIC DISHWASHING DETERGENT COMPOSITION

(71) Applicant: The Procter & Gamble Company, Cincinnati, OH (US)

(72) Inventors: Nilgun Esin Aksoy Abaci, Meise (BE); Patrick Firmin August Delplancke, Wijnhuize (BE); Nevena Lukic, Brussels (BE); William Mario Laurent Verstraeten, Herent (BE)

(73) Assignee: The Procter & Gamble Company, Cincinnati, OH (US)

( * ) Notice: Subject to any disclaimer, the term of this patent is extended or adjusted under 35 U.S.C. 154(b) by 73 days.

(21) Appl. No.: 16/912,726

(22) Filed: Jun. 26, 2020

(65) Prior Publication Data

US 2021/0002587 A1 Jan. 7, 2021

(30) Foreign Application Priority Data

Jul. 2, 2019 (EP) ..... 19183953

(51) Int. Cl.

| | |
|---|---|
| ***C11D 3/04*** | (2006.01) |
| ***C11D 3/33*** | (2006.01) |
| ***C11D 3/37*** | (2006.01) |
| ***C11D 3/20*** | (2006.01) |
| ***C11D 1/34*** | (2006.01) |
| ***C11D 1/38*** | (2006.01) |
| ***C11D 1/835*** | (2006.01) |
| ***C11D 3/08*** | (2006.01) |
| ***C11D 3/10*** | (2006.01) |
| ***C11D 3/386*** | (2006.01) |
| ***C11D 3/39*** | (2006.01) |
| ***C11D 11/00*** | (2006.01) |
| ***C11D 17/00*** | (2006.01) |
| ***C11D 17/04*** | (2006.01) |
| ***C11D 17/06*** | (2006.01) |
| ***C11D 3/32*** | (2006.01) |
| ***C11D 1/722*** | (2006.01) |
| ***C11D 1/72*** | (2006.01) |
| ***C11D 3/36*** | (2006.01) |

(52) U.S. Cl.

CPC ..... *C11D 3/2082* (2013.01); *C11D 1/342* (2013.01); *C11D 1/38* (2013.01); *C11D 1/72* (2013.01); *C11D 1/722* (2013.01); *C11D 1/835* (2013.01); *C11D 3/08* (2013.01); *C11D 3/10* (2013.01); *C11D 3/32* (2013.01); *C11D 3/33* (2013.01); *C11D 3/361* (2013.01); *C11D 3/378* (2013.01); *C11D 3/3761* (2013.01); *C11D 3/3765* (2013.01); *C11D 3/3769* (2013.01); *C11D 3/38609* (2013.01); *C11D 3/3902* (2013.01); *C11D 3/3905* (2013.01); *C11D 3/3942* (2013.01); *C11D 11/0035* (2013.01); *C11D 17/0065* (2013.01); *C11D 17/042* (2013.01); *C11D 17/043* (2013.01); *C11D 17/044* (2013.01); *C11D 17/045* (2013.01); *C11D 17/06* (2013.01)

(58) Field of Classification Search

CPC .. C11D 1/72; C11D 1/722; C11D 3/08; C11D 3/10; C11D 3/32; C11D 3/33; C11D 3/361; C11D 33/3761; C11D 3/3765; C11D 3/3902; C11D 3/3905; C11D 17/043; C11D 17/044; C11D 17/045

USPC ..... 510/221, 222, 223, 226, 230, 439, 467, 510/475, 499, 501, 370, 372, 376

See application file for complete search history.

(56) References Cited

U.S. PATENT DOCUMENTS

| | | | | |
|---|---|---|---|---|
| 10,047,323 | B2 | 8/2018 | Letzelter et al. | |
| 2016/0348036 | A1 | 12/2016 | Beers | |
| 2017/0292092 | A1* | 10/2017 | Asmanidou | C11D 3/2079 |
| 2017/0355929 | A1* | 12/2017 | Letzelter | C11D 3/3769 |
| 2018/0030386 | A1* | 2/2018 | Tarbit | C12N 9/54 |
| 2018/0134992 | A1* | 5/2018 | Scialla | C11D 3/3788 |
| 2018/0179475 | A1* | 6/2018 | Jackson | C11D 3/38681 |
| 2019/0106658 | A1 | 4/2019 | Vasquez Valdivieso | |

FOREIGN PATENT DOCUMENTS

| | | | |
|---|---|---|---|
| EP | 3050954 | A1 | 8/2016 |
| WO | WO2015070976 | A1 | 5/2015 |

OTHER PUBLICATIONS

International Search Report and Written Opinion; Application Ser. No. PCT/US2020/070226; dated Oct. 30, 2020; 13 pages.

Extended European Search Report; Application No. 19183953.9-1105; dated Dec. 16, 2019; 8 pages.

* cited by examiner

*Primary Examiner* — Gregory R Delcotto

(74) *Attorney, Agent, or Firm* — Carolyn S. Powell; Abbey A. Lopez

(57) ABSTRACT

An automatic dishwashing cleaning composition comprising:

a) a mixed builder system comprising soluble builder and crystalline silicate wherein the soluble builder comprises a complexing agent, a phosphonate and a dispersant polymer and wherein the level of each soluble builder in the composition is:
   - a1) from 15% to 40% by weight of the composition of the complexing agent;
   - a2) from 2% to 7% by weight of the composition of the phosphonate; and
   - a3) from 1% to 7% by weight of the composition of the dispersant polymer wherein the soluble builder and the crystalline silicate are in a weight ratio of from 8:1 to 15:1 b) a bleaching system comprising bleach, a bleach catalyst and a bleach activator; and c) from 0% to 20% by weight of the composition of carbonate.

10 Claims, No Drawings

AUTOMATIC DISHWASHING DETERGENT COMPOSITION

TECHNICAL FIELD

The present invention is in the field of automatic dishwashing. In particular it relates to a composition that is able to provide effective cleaning, shine and care. The composition provides good removal of tea stains even when used in hard water with high level of bicarbonate. The invention also relates to a method of using the composition and the use of the composition to provide tea stain removal.

BACKGROUND OF THE INVENTION

Automatic dishwashing is expected to leave items clean and shiny, i.e., devoid of soil residues, filming and spotting. Tea stains seem to be one of the toughest stains to remove from tableware in automatic dishwashing.

WO2015/124384A1 provides a zero-phosphate machine dish wash composition in unit dose format comprising non-phosphate builder, alkali percarbonate, a manganese bleach catalyst in relative low amounts and one or more polycarboxylate polymers. The builder comprises one or more from methylglycine-N,N-diacetic acid and/or one or more salts thereof, citric acid and/or one or more salts thereof, and glutamic acid-N,N-diacetic acid and/or one or more salts thereof. The polycarboxylate polymers have a weight average molecular weight of between 1000 and 100,000, the polymers comprising at least 20% mol of acrylate monomers and from 0 to 40% mol of maleate monomers. The composition is said to provide improved tea stain removal upon use.

WO2015/0700976 A1 provides a composition comprising a) from 10 to 90% by weight of one or more builders, where at least 10% by weight, in relation to the total quantity of the builder(s), consists of crystalline sodium phyllosilicate of the formula (1) Na2SixO2x+1−y $H_2O$ where x is a number from 1.9 to 4 and y is a number from 0 to 20, b) from 0.0025 to 2.0000% of one or more bleaching catalysts, c) from 0.1 to 20% by weight of one or more oxygen-containing bleaching agents, d) from 0 to 10% by weight of one or more bleach activators, e) from 1 to 85% by weight of one or more pH regulators, f) from 0 to 10% by weight of one or more surface-active substances and g) from 0 to 5% by weight of one or more enzymes; where the quantities stated of the components a) to g) relate to the total quantity of the composition. This composition has excellent suitability as composition for use in dishwashing machines.

Although many attempts have been made in the past, there is still an unmet need to remove tea stains and at the same time provide good cleaning and shine in automatic dishwashing. It has been found that tea stain removal is highly dependent on the nature of the water used in the automatic dishwashing process. It seems particularly relevant the presence of high levels of hardness and bicarbonate in the water.

Recently, unit dose products, such as pouches have become widely used in automatic dishwashing. The unit dose product is delivered from the dishwasher dispenser and therefore it has to have a volume such that fits into the dispenser. This limits the amount of chemistry that can be used per wash.

One of the objectives of the present invention is to provide an automatic dishwashing composition that provides good tea stain removal across a whole variety of water hardness and at the same time good cleaning of other soils and shine. Preferably, the composition should be suitable to be presented in unit dose form.

SUMMARY OF THE INVENTION

According to the first aspect of the invention, there is provided an automatic dishwashing composition. The composition provides effective cleaning, in particular tea stain removal, while at the same time leaving the washed items shiny and providing care for the items. The composition is suitable to be provided in unit dose form.

The automatic dishwashing detergent composition comprises a mixed builder system. The mixed builder system comprises soluble builder and a crystalline silicate. The soluble builder and the crystalline silicate are in a weight ratio of from 8:1 to 15:1. It has been found that the weight ratio of soluble builder to crystalline silicate is critical to get good cleaning and to have good shine. Compositions having a soluble builder to crystalline silicate ratio outside this range seem to have a negative impact on the filming of the washed items.

It has also been found that the builder system requires a plurality of builders. The different builders seem to have a different building mechanism. The same cleaning and shine performance does not seem to be obtained with builder systems having less variety of builders even if a higher level of the system is used. The mixed builder system comprises soluble builder and a crystalline silicate. The soluble builder comprises a complexing agent, a phosphonate and a dispersant polymer.

The composition also comprises a bleaching system. The bleaching system comprises bleach, a bleach catalyst and a bleach activator.

The composition also comprises a low level of carbonate, preferably less than 20%, more preferably less than 15% by weight of the composition.

The specific combination of the mixed builder system having the soluble builder and the crystalline silicate in a certain weight ratio, the bleach system and the low level of carbonate, gives rise to a composition with excellent cleaning properties, especially on tea stain removal. The composition also provides good shine. This is achieved even when the composition is in unit dose form. The composition performs well across a wide range of water hardness, even with waters having a high level of bicarbonate.

The automatic dishwashing detergent composition of the invention comprises:

a) a mixed builder system. The mixed builder system comprises soluble builder and crystalline silicate builder. The soluble builder comprises a complexing agent, a phosphonate and a dispersant polymer. The level of each soluble builder in the composition is:
   - a1) from 15% to 40% by weight of the composition of the complexing agent;
   - a2) from 2% to 7% by weight of the composition of the phosphonate; and
   - a3) from 1% to 7% by weight of the composition of the dispersant polymer wherein the soluble builder and the crystalline silicate builder are in a weight ratio of from 8:1 to 15:1 b) a bleaching system comprising bleach, a bleach catalyst and a bleach activator; and c) from 0% to 20% by weight of the composition of carbonate.

According to a second aspect of the invention there is provided a water-soluble automatic dishwashing cleaning pouch comprising a water-soluble enveloping material and the composition of the invention.

According to a third aspect of the invention there is provided an automatic dishwashing method using the composition of the invention. The method provides very good cleaning, including tea cleaning, shine and care under a wide range of water hardness conditions.

According to a fourth aspect of the invention there is provided the use of the composition of the invention to provide tea cleaning in automatic dishwashing using water hard water comprising high level of bicarbonate.

The elements of the composition of the invention described in connection with the first aspect of the invention apply mutatis mutandis to the other aspects of the invention.

DETAILED DESCRIPTION OF THE INVENTION

The present invention envisages an automatic dishwashing detergent composition comprising a mixed builder system, a bleaching system and low level of carbonate. The mixed builder system is critical to provide the good cleaning, in particular good tea cleaning.

The mixed builder system comprises a plurality of builders: a high level of non-phosphate builder, preferably MGDA, more preferably the trisodium salt of methylglycine-N,N-diacetic acid, high level of 1-hydroxyethane 1,1-diphosphonic acid (HEDP), dispersant polymer, and crystalline silicate.

The bleaching system comprises bleach, bleach catalyst and bleach activator.

The composition herein is preferably phosphate free. By "phosphate-free" is herein understood that the composition comprises less than 1%, preferably less than 0.1% by weight of the composition of phosphate.

Detergent Composition

The detergent composition of the invention can be presented in any form. Preferably, the composition or part thereof is the form of loose powder and more preferable the composition is provided in unit-dose form. The composition of the invention is very well suited to be presented in the form of a multi-compartment pack, more in particular a multi-compartment pack comprising compartments with compositions in different physical forms, for example a compartment comprising a composition in the form of loose powder and another compartment comprising a composition in liquid form. The composition is preferably enveloped by a water-soluble film such as polyvinyl alcohol. The composition comprises a mixed builder system and a bleaching system, low level of carbonate and optionally non-ionic surfactant, enzymes, and glass and/or metal care agents. Preferably, the composition comprises the tri-sodium salt of MGDA, HEDP, dispersant polymer preferably a sulfonated polymer comprising 2-acrylamido-2-methylpropane sulfonic acid monomers, crystalline sodium silicate, sodium carbonate, a bleach, preferably sodium percarbonate, a bleach activator, preferably TAED, a bleach catalyst, preferably a manganese bleach catalyst and optionally but preferably protease and amylase enzymes and non-ionic surfactant. The composition is preferably free of citrate. The composition can further comprise a cationic polymer that provides anti-spotting benefits.

The composition of the invention preferably has a pH as measured in 1% weight/volume aqueous solution in distilled water at 20° C. of from about 9 to about 12, more preferably from about 10 to less than about 11.5 and especially from about 10.5 to about 11.5.

The composition of the invention preferably has a reserve alkalinity of from about 10 to about 20, more preferably from about 12 to about 18 at a pH of 9.5 as measured in NaOH with 100 mL of product at 20° C.

Mixed Builder System

Complexing Agent

Complexing agents are materials capable of sequestering hardness ions, particularly calcium and/or magnesium. The composition of the invention comprises a high level of complexing agent, however the level should not be too high otherwise enzymes, in particular proteases can be negatively affected. Too high level of complexing agent can also negatively impact on glass care.

The composition of the invention comprises from 15% to 40%, preferably from 20% to 40%, more preferably from 20% to 35% by weight of the composition of a complexing agent selected from the group consisting of methylglycine-N,N-diacetic acid (MGDA), citric acid, glutamic acid-N,N-diacetic acid (GLDA) its salts and mixtures thereof. Especially preferred complexing agent for use herein is a salt of MGDA, in particular the trisodium salt of MGDA. Preferably, the composition of the invention comprises from 15% to 40% by weight of the composition of the trisodium salt of MGDA.

Crystalline Sodium Silicate

The composition of the present invention comprises from 2% to 8%, preferably from 3% to 6% by weight of the composition of a crystalline sodium silicate. The crystalline sodium silicate, is preferably a layered silicate and preferably has the composition $NaMSi_x O_{2x+1.y} H_2O$, in which M denotes sodium or hydrogen, x is 1.9 to 4 and y is 0 to 20.

The crystalline sodium silicates used according to the invention prove to be layered in scanning electron microscope photographs.

From the known compounds of the formula $Na2Si_xO_{2x+1.y} H_2O$, the corresponding compounds $NaHSi_x O_{2x+1.y}H_2O$ can be prepared by treatment with acids and, in some cases, also with water. The water content given by the number y makes no differentiation between water of crystallization and adhering water. M preferably represents sodium. Preferred values of x are from 1.9 to 4. Compounds having the composition $NaMSi_2O_{5.y}H_2O$ are particularly preferred. Since the sodium silicates employed according to the invention are crystalline compounds, they can easily be characterized by their X-ray diffraction diagrams.

Preferred layered crystalline silicates are those, in which x in the aforesaid general formula assumes the values 1.9 to 3.5.

In particular, both delta-and beta-disodium disilicate (Na2Si2O5 yH2O) are preferred, with beta-disodium disilicate can be obtained, for example, by the process described in WO 91/08171 A1. Beta-disodium silicates with a molar ratio of SiO 2/Na 2 O between 1, 9 and 3.2 can be prepared according to Japanese Patent Application JP04/238809A or JP04/260610A. It can also be prepared from amorphous silicates, practically anhydrous crystalline alkali metal silicates of the abovementioned general formula (1), in which x is a number from 1, 9 to 2.1.

In a further preferred embodiment of such agents, a crystalline sodium layer silicate with a molar ratio of SiO2/Na2O of 1.8 to 3 is used. In a preferred form, crystalline layered disodium disilicate builder is form from varying percentages of polymorphic phases alpha, beta and delta together. In commercially produced products, amorphous portions may also be present.

The definitions of alpha, beta and delta disodium disilicate are known and can be found, for example, in EP0164514A1, as set forth below. The disodium state is preferably a layered crystalline disodium disilicate which consists of at least one of the polymorphic phases of the disodium disilicate and of sodium silicates of non-layered silicate nature. Particular preference is given to using crystalline sodium layer silicates having a content of from 80 to 100% by weight of delta-disodium disilicate. In a further preferred variant, it is also possible to use crystalline sodium layer silicates having a content of 70 to 100% by weight of beta disodium disilicate.

Crystalline sodium layer silicates used with particular preference contain 1 to 40% by weight of alpha disodium disilicate, 0 to 50% by weight, in particular 0 to 45% by weight, of beta disodium disilicate, 50 to 98% by weight of delta disodium disilicate and 0 to 40% by weight of non-silicate sodium silicates (amorphous portions).

Very particularly preferably used crystalline layered sodium silicates contain 7 to 21 wt % alpha disodium disilicate, 0 to 12 wt % beta disodium disilicate, 65 to 95 wt % delta disodium disilicate and 0 to 20 wt % amorphous shares.

The abovementioned alpha-disodium disilicate corresponds to the Na-SK-S5 described in EP0164514 A1, characterized by those reproduced by X-ray diffraction data assigned to alpha-Na2Si2O5. The X-ray diffraction diagrams are available from the Joint Committee of Powder Diffraction Standards are registered under numbers 18-1241, 22-1397, 22-1397A, 19-1233, 19-1234 and 19-1237.

The abovementioned beta-disodium disilicate corresponds to the Na-SKS-7 described in EP064514 A1, characterized by those reproduced there X-ray diffraction data assigned to beta-Na2Si2O5. The X-ray diffraction diagrams are available from the Joint Committee of Powder Diffraction Standards registered under the numbers 24-1 123 and 29-1261.

The abovementioned delta-disodium disilicate corresponds to that in EP0164514A described Na-SKS-6, characterized by the reproduced there X-ray diffraction data assigned to the delta-Na2Si2O5. The X-ray diffraction patterns are registered with the Joint Committee of Powder Diffraction Standards under the number 22-1396.

The compositions according to the invention contain crystalline sodium layer silicate of the formula (1) in granulated form, and also cogranules containing crystalline sodium layer silicate and sparingly soluble metal carbonate, as described, for example, in WO2007/101622 A1.

In a further preferred embodiment of the invention, the compositions of invention according to contain crystalline sodium disilicates Na2Si205 yH20 with y=0 to 2.

In a preferred form, the crystalline layered sodium silicates additionally contain cationic and/or anionic constituents. The cationic constituents are preferably combinations of alkali metal and/or alkaline earth metal cations and/or Fe, W, Mo, Ta, Pb, Al, Zn, Ti, V, Cr, Mn, Co and/or Ni.

The anionic constituents are preferably aluminates, sulfates, fluorides, chlorides, bromides, iodides, carbonates, bicarbonates, nitrates, oxide hydrates, phosphates and/or borates.

In an alternative preferred form containing crystalline layered sodium silicates, based on the total content of SiO2, up to 10 mol % boron. In another alternative preferred form include the crystalline layered sodium silicates, based on the total content of $SiO_2$, up to 20 mol % Phosphorus.

Also, particularly preferred are sodium disilicates prepared hydrothermally of formula beta-Na are 2 Si205, as described in patent documents WO92/09526 A1, U.S. Pat. No. 5,417,951, DE 41 02 743 A1 and WO92/13935 A1, As sodium layer silicates, those according to WO00/09444 A1 are particularly preferred. Further preferred sodium layer silicates are those according to EP 0 550 048 A1 and EP 0 630 855 A1.

The especially preferred silicate for use herein has the formula: $Na_2Si_2O_5$.

Carbonate

The composition of the invention comprises a low level of carbonate. It comprises from 0% to 20%, preferably 0% to 15% by weight of the composition of sodium carbonate.

Phosphonate

The composition of the invention comprises a high level of phosphonate, preferably HEDP. It comprises from 2% to 7%, preferably 2% to 6% by weight of the composition of HEDP.

Dispersant Polymer

The dispersant polymer is used in any suitable amount from about 1 to about 7%, preferably from 2 to about 6% by weight of the composition.

The dispersant polymer is capable to suspend calcium or calcium carbonate in an automatic dishwashing process. Preferably, the dispersant polymers are sulfonated derivatives of polycarboxylic acids and may comprise two, three, four or more different monomer units. The preferred copolymers contain:

At least one structural unit derived from a carboxylic acid monomer having the general formula (III):

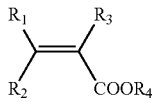

(III)

wherein $R_1$ to $R_3$ are independently selected from hydrogen, methyl, linear or branched saturated alkyl groups having from 2 to 12 carbon atoms, linear or branched mono or polyunsaturated alkenyl groups having from 2 to 12 carbon atoms, alkyl or alkenyl groups as aforementioned substituted with —NH2 or —OH, or —COOH, or $COOR_4$, where $R_4$ is selected from hydrogen, alkali metal, or a linear or branched, saturated or unsaturated alkyl or alkenyl group with 2 to 12 carbons;

Preferred carboxylic acid monomers include one or more of the following: acrylic acid, maleic acid, maleic anhydride, itaconic acid, citraconic acid, 2-phenylacrylic acid, cinnamic acid, crotonic acid, fumaric acid, methacrylic acid, 2-ethylacrylic acid, methylenemalonic acid, or sorbic acid. Acrylic and methacrylic acids being more preferred.

Optionally, one or more structural units derived from at least one nonionic monomer having the general formula (IV):

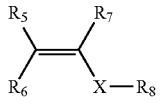

(IV)

Wherein $R_5$ to $R_7$ are independently selected from hydrogen, methyl, phenyl or hydroxyalkyl groups containing 1 to 6 carbon atoms, and can be part of a cyclic structure, X is an optionally present spacer group which is selected from —$CH_2$—, —COO—, —CONH— or —$CONR_8$—, and $R_8$ is selected from linear or branched, saturated alkyl radicals having 1 to 22 carbon atoms or unsaturated, preferably aromatic, radicals having from 6 to 22 carbon atoms.

Preferred non-ionic monomers include one or more of the following: butene, isobutene, pentene, 2-methylpent-1-ene, 3-methylpent-1-ene, 2,4,4-trimethylpent-1-ene, 2,4,4-trimethylpent-2-ene, cyclopentene, methylcyclopentene, 2-methyl-3-methyl-cyclopentene, hexene, 2,3-dimethylhex-1-ene, 2,4-dimethylhex-1-ene, 2,5-dimethylhex-1-ene, 3,5-dimethylhex-1-ene, 4,4-dimethylhex-1-ene, cyclohexene, methylcyclohexene, cycloheptene, alpha olefins having 10 or more carbon atoms such as, dec-1-ene, dodec-1-ene, hexadec-1-ene, octadec-1-ene and docos-1-ene, preferred aromatic monomers are styrene, alpha methylstyrene, 3-methylstyrene, 4-dodecylstyrene, 2-ethyl-4-bezylstyrene, 4-cyclohexylstyrene, 4-propylstyrol, 1-vinylnaphtalene, 2-vinylnaphtalene; preferred carboxylic ester monomers are methyl (meth)acrylate, ethyl (meth)acrylate, propyl (meth) acrylate, t-butyl (meth)acrylate, pentyl (meth)acrylate, hexyl (meth)acrylate, 2-ethylhexyl (meth)acrylate, octyl (meth) acrylate, lauryl (meth)acrylate, stearyl (meth)acrylate and behenyl (meth)acrylate; preferred amides are N-methyl acrylamide, N-ethyl acrylamide, N-t-butyl acrylamide, N-2-ethylhexyl acrylamide, N-octyl acrylamide, N-lauryl acrylamide, N-stearyl acrylamide, N-behenyl acrylamide; and at least one structural unit derived from at least one sulfonic acid monomer having the general formula (V) and (VI):

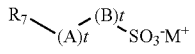

(V)

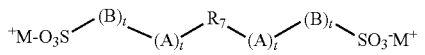

(VI)

wherein $R_7$ is a group comprising at least one sp2 bond, A is O, N, P, S, an amido or ester linkage, B is a mono- or polycyclic aromatic group or an aliphatic group, each t is independently 0 or 1, and M+ is a cation. In one aspect, $R_7$ is a C2 to C6 alkene. In another aspect, R7 is ethene, butene or propene.

Preferred sulfonated monomers include one or more of the following: 1-acrylamido-1-propanesulfonic acid, 2-acrylamido-2-propanesulfonic acid, 2-acrylamido-2-methyl-1-propanesulfonic acid, 2-methacrylamido-2-methyl-1-propanesulfonic acid, 3-methacrylamido-2-hydroxy-propanesulfonic acid, allylsulfonic acid, methallylsulfonic acid, allyloxybenzenesulfonic acid, methallyloxybenzenesulfonic acid, 2-hydroxy-3-(2-propenyloxy) propanesulfonic acid, 2-methyl-2-propen-1-sulfonic acid, styrenesulfonic acid, vinylsulfonic acid, 3-sulfopropyl, 3-sulfo-propylmethacrylate, sulfomethacrylamide, sulfomethylmethacrylamide and mixtures of said acids or their water-soluble salts.

Preferably, the polymer comprises the following levels of monomers: from about 40 to about 90%, preferably from about 60 to about 90% by weight of the polymer of one or more carboxylic acid monomer; from about 5 to about 50%, preferably from about 10 to about 40% by weight of the polymer of one or more sulfonic acid monomer; and optionally from about 1% to about 30%, preferably from about 2 to about 20% by weight of the polymer of one or more non-ionic monomer. An especially preferred polymer comprises about 70% to about 80% by weight of the polymer of at least one carboxylic acid monomer and from about 20% to about 30% by weight of the polymer of at least one sulfonic acid monomer.

In the polymers, all or some of the carboxylic or sulfonic acid groups can be present in neutralized form, i.e. the acidic hydrogen atom of the carboxylic and/or sulfonic acid group in some or all acid groups can be replaced with metal ions, preferably alkali metal ions and in particular with sodium ions.

The carboxylic acid is preferably (meth)acrylic acid. The sulfonic acid monomer is preferably 2-acrylamido-2-propanesulfonic acid (AMPS).

Preferred commercial available polymers include: Alcosperse 240, Aquatreat AR 540 and Aquatreat MPS supplied by Alco Chemical; Acumer 3100, Acumer 2000, Acusol 587G and Acusol 588G supplied by Dow; Goodrich K-798, K-775 and K-797 supplied by BF Goodrich; and ACP 1042 supplied by ISP technologies Inc. Particularly preferred polymers are Acusol 587G and Acusol 588G supplied by Rohm & Haas.

Suitable dispersant polymers include anionic carboxylic polymer of low molecular weight. They can be homopolymers or copolymers with a weight average molecular weight of less than or equal to about 200,000 g/mol, or less than or equal to about 75,000 g/mol, or less than or equal to about 50,000 g/mol, or from about 3,000 to about 50,000 g/mol, preferably from about 5,000 to about 45,000 g/mol. The dispersant polymer may be a low molecular weight homopolymer of polyacrylate, with an average molecular weight of from 1,000 to 20,000, particularly from 2,000 to 10,000, and particularly preferably from 3,000 to 5,000.

The dispersant polymer may be a copolymer of acrylic with methacrylic acid, acrylic and/or methacrylic with maleic acid, and acrylic and/or methacrylic with fumaric acid, with a molecular weight of less than 70,000. Their molecular weight ranges from 2,000 to 80,000 and more preferably from 20,000 to 50,000 and in particular 30,000 to 40,000 g/mol. and a ratio of (meth)acrylate to maleate or fumarate segments of from 30:1 to 1:2.

The dispersant polymer may be a copolymer of acrylamide and acrylate having a molecular weight of from 3,000 to 100,000, alternatively from 4,000 to 20,000, and an acrylamide content of less than 50%, alternatively less than 20%, by weight of the dispersant polymer can also be used. Alternatively, such dispersant polymer may have a molecular weight of from 4,000 to 20,000 and an acrylamide content of from 0% to 15%, by weight of the polymer.

Dispersant polymers suitable herein also include itaconic acid homopolymers and copolymers. Alternatively, the dispersant polymer can be selected from the group consisting of alkoxylated polyalkyleneimines, alkoxylated polycarboxylates, polyethylene glycols, styrene co-polymers, cellulose sulfate esters, carboxylated polysaccharides, amphiphilic graft copolymers and mixtures thereof.

Bleaching System

Bleach

The composition of the invention preferably comprises from about 8 to about 30%, more preferably from about 9 to about 25%, even more preferably from about 9 to about 20% of bleach by weight of the composition.

Inorganic and organic bleaches are suitable for use herein. Inorganic bleaches include perhydrate salts such as perborate, percarbonate, persulfate and persilicate salts. The inorganic perhydrate salts are normally the alkali metal salts. The inorganic perhydrate salt may be included as the crystalline solid without additional protection. Alternatively, the salt can be coated. Suitable coatings include sodium sulphate, sodium carbonate, sodium silicate and mixtures thereof. Said coatings can be applied as a mixture applied to the surface or sequentially in layers.

Alkali metal percarbonates, particularly sodium percarbonate is the preferred bleach for use herein. The percarbonate is most preferably incorporated into the products in a coated form which provides in-product stability.

Potassium peroxymonopersulfate is another inorganic perhydrate salt of utility herein.

Typical organic bleaches are organic peroxyacids, especially dodecanediperoxoic acid, tetradecanediperoxoic acid, and hexadecanediperoxoic acid. Mono- and diperazelaic acid, mono-and diperbrassylic acid are also suitable herein. Diacyl and Tetraacylperoxides, for instance dibenzoyl peroxide and dilauroyl peroxide, are other organic peroxides that can be used in the context of this invention.

Further typical organic bleaches include the peroxyacids, particular examples being the alkylperoxy acids and the arylperoxy acids. Preferred representatives are (a) peroxybenzoic acid and its ring-substituted derivatives, such as alkylperoxybenzoic acids, but also peroxy-α-naphthoic acid and magnesium monoperphthalate, (b) the aliphatic or substituted aliphatic peroxy acids, such as peroxylauric acid, peroxystearic acid, ε-phthalimidoperoxycaproic acid[phthaloiminoperoxyhexanoic acid (PAP)], o-carboxybenzamidoperoxycaproic acid, N-nonenylamidoperadipic acid and N-nonenylamidopersuccinates, and (c) aliphatic and araliphatic peroxydicarboxylic acids, such as 1,12-diperoxycarboxylic acid, 1,9-diperoxyazelaic acid, diperoxysebacic acid, diperoxybrassylic acid, the diperoxyphthalic acids, 2-decyldiperoxybutane-1,4-dioic acid, N,N-terephthaloyldi (6-aminopercaproic acid).

Bleach Activators

Bleach activators are typically organic peracid precursors that enhance the bleaching action in the course of cleaning at temperatures of 60° C. and below. Bleach activators suitable for use herein include compounds which, under perhydrolysis conditions, give aliphatic peroxoycarboxylic acids having preferably from 1 to 12 carbon atoms, in particular from 2 to 10 carbon atoms, and/or optionally substituted perbenzoic acid. Suitable substances bear O-acyl and/or N-acyl groups of the number of carbon atoms specified and/or optionally substituted benzoyl groups. Preference is given to polyacylated alkylenediamines, in particular tetraacetylethylenediamine (TAED), acylated triazine derivatives, in particular 1,5-diacetyl-2,4-dioxohexahydro-1,3,5-triazine (DADHT), acylated glycolurils, in particular tetraacetylglycoluril (TAGU), N-acylimides, in particular N-nonanoylsuccinimide (NOSI), acylated phenolsulfonates, in particular n-nonanoyl- or isononanoyloxybenzenesulfonate (n- or iso-NOBS), decanoyloxybenzoic acid (DOBA), carboxylic anhydrides, in particular phthalic anhydride, acylated polyhydric alcohols, in particular triacetin, ethylene glycol diacetate and 2,5-diacetoxy-2,5-dihydrofuran and also triethylacetyl citrate (TEAC). If present the composition of the invention comprises from 0.01 to 5, preferably from 0.2 to 2% by weight of the composition of bleach activator, preferably TAED.

Bleach Catalyst

The composition herein preferably contains a bleach catalyst, preferably a metal containing bleach catalyst. More preferably the metal containing bleach catalyst is a transition metal containing bleach catalyst, especially a manganese or cobalt-containing bleach catalyst.

Bleach catalysts preferred for use herein include manganese triazacyclononane and related complexes; Co, Cu, Mn and Fe bispyridylamine and related complexes; and pentamine acetate cobalt(III) and related complexes.

Preferably the composition of the invention comprises from 0.001 to 0.5, more preferably from 0.002 to 0.05% of bleach catalyst by weight of the composition. Preferably the bleach catalyst is a manganese bleach catalyst.

Surfactant

Surfactants suitable for use herein include non-ionic surfactants, preferably the compositions are free of any other surfactants. Traditionally, non-ionic surfactants have been used in automatic dishwashing for surface modification purposes in particular for sheeting to avoid filming and spotting and to improve shine. It has been found that non-ionic surfactants can also contribute to prevent redeposition of soils.

Preferably the composition of the invention comprises a non-ionic surfactant or a non-ionic surfactant system, more preferably the non-ionic surfactant or a non-ionic surfactant system has a phase inversion temperature, as measured at a concentration of 1% in distilled water, between 40 and 70° C., preferably between 45 and 65° C. By a "non-ionic surfactant system" is meant herein a mixture of two or more non-ionic surfactants. Preferred for use herein are non-ionic surfactant systems. They seem to have improved cleaning and finishing properties and better stability in product than single non-ionic surfactants.

Phase inversion temperature is the temperature below which a surfactant, or a mixture thereof, partitions preferentially into the water phase as oil-swollen micelles and above which it partitions preferentially into the oil phase as water swollen inverted micelles. Phase inversion temperature can be determined visually by identifying at which temperature cloudiness occurs.

The phase inversion temperature of a non-ionic surfactant or system can be determined as follows: a solution containing 1% of the corresponding surfactant or mixture by weight of the solution in distilled water is prepared. The solution is stirred gently before phase inversion temperature analysis to ensure that the process occurs in chemical equilibrium. The phase inversion temperature is taken in a thermostable bath by immersing the solutions in 75 mm sealed glass test tube. To ensure the absence of leakage, the test tube is weighed before and after phase inversion temperature measurement. The temperature is gradually increased at a rate of less than 1° C. per minute, until the temperature reaches a few degrees below the pre-estimated phase inversion temperature. Phase inversion temperature is determined visually at the first sign of turbidity.

Suitable nonionic surfactants include: i) ethoxylated nonionic surfactants prepared by the reaction of a monohydroxy alkanol or alkyphenol with 6 to 20 carbon atoms with preferably at least 12 moles particularly preferred at least 16 moles, and still more preferred at least 20 moles of ethylene oxide per mole of alcohol or alkylphenol; ii) alcohol alkoxylated surfactants having a from 6 to 20 carbon atoms and at least one ethoxy and propoxy group. Preferred for use herein are mixtures of surfactants i) and ii).

Other suitable non-ionic surfactants are epoxy-capped poly(oxyalkylated) alcohols represented by the formula:

$$R1O[CH2CH(CH3)O]_x[CH2CH2O]_y[CH2CH(OH)R2] \quad (I)$$

wherein R1 is a linear or branched, aliphatic hydrocarbon radical having from 4 to 18 carbon atoms; R2 is a linear or branched aliphatic hydrocarbon radical having from 2 to 26 carbon atoms; x is an integer having an average value of from 0.5 to 1.5, more preferably about 1; and y is an integer having a value of at least 15, more preferably at least 20.

Preferably, the surfactant of formula I, at least about 10 carbon atoms in the terminal epoxide unit [CH2CH(OH) R2]. Suitable surfactants of formula I, according to the present invention, are Olin Corporation's POLY-TERGENT® SLF-18B nonionic surfactants, as described, for example, in WO 94/22800, published Oct. 13, 1994 by Olin Corporation.

Enzymes

In describing enzyme variants herein, the following nomenclature is used for ease of reference: Original amino acid(s):position(s): substituted amino acid(s). Standard enzyme IUPAC 1-letter codes for amino acids are used.

Proteases

The composition of the invention is beneficial in terms of removal of proteinaceous soils, in particular sugary burn soils such as creme brulee.

Suitable proteases include metalloproteases and serine proteases, including neutral or alkaline microbial serine proteases, such as subtilisins (EC 3.4.21.62) as well as chemically or genetically modified mutants thereof. Suitable proteases include subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii.*

Especially preferred proteases for the detergent of the invention are polypeptides demonstrating at least 90%, preferably at least 95%, more preferably at least 98%, even more preferably at least 99% and especially 100% identity with the wild-type enzyme from *Bacillus lentus*, comprising mutations in one or more, preferably two or more and more preferably three or more of the following positions, using the BPN' numbering system and amino acid abbreviations as illustrated in WO00/37627, which is incorporated herein by reference: V68A, N87S, S99D, S99SD, S99A, S101G, S101M, S103A, V104N/I, G118V, G118R, S128L, P129Q, S130A, Y167A, R170S, A194P, V2051 and/or M222S.

Most preferably the protease is selected from the group comprising the below mutations (BPN' numbering system) versus either the PB92 wild-type (SEQ ID NO:2 in WO 08/010925) or the subtilisin 309 wild-type (sequence as per PB92 backbone, except comprising a natural variation of N87S).

(i) G118V+S128L+P129Q+S130A (ii) S101M+G118V+S128L+P129Q+5130A (iii) N76D+N87R+G118R+S128L+P129Q+5130A+S188D+N248R (iv) N76D+N87R+G118R+S128L+P129Q+5130A+S188D+V244R (v) N76D+N87R+G118R+S128L+P129Q+5130A (vi) V68A+N87S+S101G+V104N Suitable commercially available protease enzymes include those sold under the trade names Savinase®, Polarzyme®, Kannase®, Ovozyme®, Everlase® and Esperase® by Novozymes A/S (Denmark), those sold under the tradename Properase®, Purafect®, Purafect Prime®, Purafect Ox®, FN3®, FN4®, Excellase®, Ultimase® and Purafect OXP® by Genencor International, those sold under the tradename Opticlean® and Optimase® by Solvay Enzymes, those available from Henkel/Kemira, namely BLAP.

Preferred levels of protease in the composition of the invention include from about 0.2 to about 2 mg of active protease per grams of the composition.

Amylases

The composition of the invention can comprise amylases. A preferred alkaline amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCIB 12289, NCIB 12512, NCIB 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) the variants described in U.S. Pat. No. 5,856,164 and WO99/23211, WO 96/23873, WO00/60060 and WO 06/002643, especially the variants with one or more substitutions in the following positions versus the AA560 SEQ ID No. 3:

9, 26, 30, 33, 82, 37, 106, 118, 128, 133, 149, 150, 160, 178, 182, 186, 193, 195, 202, 214, 231, 256, 257, 258, 269, 270, 272, 283, 295, 296, 298, 299, 303, 304, 305, 311, 314, 315, 318, 319, 320, 323, 339, 345, 361, 378, 383, 419, 421, 437, 441, 444, 445, 446, 447, 450, 458, 461, 471, 482, 484, preferably that also contain the deletions of D183* and G184*.

(b) variants exhibiting at least 95% identity with the wild-type enzyme from *Bacillus* sp.707 (SEQ ID NO:7 in U.S. Pat. No. 6,093,562), especially those comprising one or more of the following mutations M202, M208, 5255, R172, and/or M261. Preferably said amylase comprises one of M202L or M202T mutations.

Suitable commercially available alpha-amylases include DURAMYL®, LIQUEZYME®, TERMAMYL®, TERMAMYL ULTRA®, NATALASE®, EVEREST®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE®, EXCELLENZ™ S series, including EXCELLENZ™ S 1000 and EXCELLENZ™ S 2000 and PURASTAR OXAM® (DuPont Industrial Biosciences, Palo Alto, Calif.) and KAM® (Kao, 14-10 Nihonbashi Kayabacho, 1-chome, Chuo-ku Tokyo 103-8210, Japan). Amylases especially preferred for use herein include NATALASE®, STAINZYME®, STAINZYME PLUS®, EXCELLENZ™ S 1000, EXCELLENZ™ S2000 and mixtures thereof.

Preferably, the composition of the invention comprises at least 0.005 mg, preferably from about 0.0025 to about 0.025, more preferably from about 0.05 to about 0.3, especially from about 0.01 to about 0.25 mg of active amylase.

Preferably, the protease and/or amylase of the composition of the invention are in the form of granulates, the granulates comprise more than 29% of sodium sulfate by weight of the granulate and/or the sodium sulfate and the active enzyme (protease and/or amylase) are in a weight ratio of between 3:1 and 100:1 or preferably between 4:1 and 30:1 or more preferably between 5:1 and 20:1.

Metal Care Agents

Metal care agents may prevent or reduce the tarnishing, corrosion or oxidation of metals, including aluminium, stainless steel and non-ferrous metals, such as silver and copper. Preferably the composition of the invention comprises from 0.1 to 5%, more preferably from 0.2 to 4% and especially from 0.3 to 3% by weight of the product of a metal care agent, preferably the metal care agent is benzo triazole (BTA).

Glass Care Agents

Glass care agents protect the appearance of glass items during the dishwashing process. Preferably the composition of the invention comprises from 0.1 to 5%, more preferably from 0.2 to 4% and specially from 0.3 to 3% by weight of the composition of a metal care agent, preferably the glass care agent is a zinc containing material, specially hydrozincite.

Cationic Polymer

The composition preferably comprises from 0.5 to 5%, preferably from 0.5 to 2% by weight of the composition of cationic polymer. The cationic polymer provides filming benefits. The cationic polymer comprises in copolymerized form from:

i. 60% to 99% by weight of the cationic polymer of at least one monoethylenically unsaturated polyalkylene oxide monomer of the formula I (monomer (A))

I

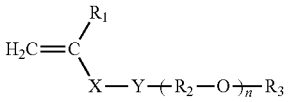

in which the variables have the following meanings:

X is —CH2- or —CO—, if Y is —O—;

X is —CO—, if Y is —NH—;

Y is —O— or —NH—;

R1 is hydrogen or methyl;

R2 are identical or different C2-C6-alkylene radicals;

R3 is H or C1-C4 alkyl;

n is an integer from 3 to 100, preferably from 15 to 60, ii. from 1 to 40% by weight of the cationic polymer of at least one quaternized nitrogen-containing monomer, selected from the group consisting of at least one of the monomers of the formula IIa to IId (monomer (B))

IIa

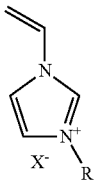

IIb

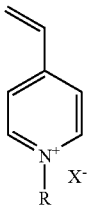

IIc

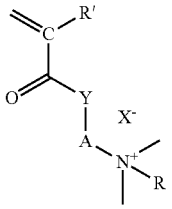

IId

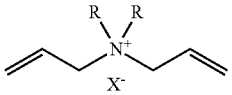

in which the variables have the following meanings:

R is C1-C4 alkyl or benzyl;

R' is hydrogen or methyl;

Y is —O— or —NH—;

A is C1-C6 alkylene;

X− is halide, C1-C4-alkyl sulfate, C1-C4-alkylsulfonate and C1-C4-alkyl carbonate.

iii. from 0 to 15% by weight of the cationic polymer of at least one anionic monoethylenically unsaturated monomer (monomer (C)), and iv. from 0 to 30% by weight of the cationic polymer of at least one other nonionic monoethylenically unsaturated monomer (monomer (D)), and the cationic polymer has a weight average molecular weight (Mw) from 2,000 to 500,000, preferably from 25,000 g/mol to 200,000 g/mol.

In preferred cationic polymers the variables of monomer (A) have the following meanings:

X is —CO—;

Y is —O—;

$R_1$ is hydrogen or methyl;

$R_2$ is ethylene, linear or branched propylene or mixtures thereof;

$R_3$ is methyl;

n is an integer from 15 to 60.

Preferably, the cationic polymer comprises from 60 to 98% by weight of monomer (A) and from 1 to 39% by weight of monomer (B) and from 0.5 to 6% by weight of monomer (C).

In preferred cationic polymers monomer (A) is methylpolyethylene glycol (meth)acrylate and wherein monomer (B) is a salt of 3-methyl-1-vinylimidazolium.

Preferably, the cationic polymer comprises from 69 to 89% of monomer (A) and from 9 to 29% of monomer (B).

In preferred cationic polymers, the weight ratio of monomer (A) to monomer (B) is 2:1 and for the case where the copolymer comprises a monomer (C), the weight ratio of monomer (B) to monomer (C) is also 2:1, more preferably is 2.5:1 and preferably monomer (A) comprises methylpolyethylene glycol (meth)acrylate and monomer (B) comprises a salt of 3-methyl-1-vinylimidazolium.

The automatic dishwashing composition of the invention preferably has a pH as measured in 1% weight/volume aqueous solution in distilled water at 25° C. of greater than 10, more preferably greater than 10.5.

The automatic dishwashing composition of the invention preferably has a reserve alkalinity of from about 10 to about 20, more preferably from about 12 to about 18 at a pH of 9.5 as measured in NaOH with 100 grams of product at 20° C.

A preferred composition according to the invention comprises:

a1) from 20% to 40% by weight of the composition of MGDA, preferably the trisodium salt of methylglycine-N, N-diacetic acid;

a2) from 2% to 6% by weight of the composition of crystalline sodium silicate having a crystalline layered structure and the composition NaMSix O2x+1.y H2O, in which M denotes sodium or hydrogen, x is a number from 1.9 to 4 and y is a number from 0 to 20, preferably having the formula $Na_2Si_2O_5$.

a3) from 0% to 20% by weight of the composition of carbonate;

a4) from 2% to 6% by weight of the composition of HEDP;

a5) from 2% to 6% by weight of the composition of a dispersant polymer, preferably a sulfonate polymer;

b1) from 8% to 30% by weight of the composition of sodium percarbonate;

b2) from 0.001% to 0.5% by weight of the composition of a manganese bleach catalyst;

b3) from 0.5% to 5% by weight of the composition of TAED;

c) non-ionic surfactant;

d) amylase;

e) protease; and optionally f) glass and/or metal care agent.

Method of Automatic Dishwashing

The method of the invention comprises the step of subjecting tableware to the composition of the invention. The method provides very good cleaning in all types of water, i.e., water with different hardness, even with water containing high level of bicarbonate. By "hard water" is herein meant water having from 2.5 to 6.5 mmol/1 of calcium and magnesium ions.

EXAMPLES

Two automatic dishwashing cleaning composition were prepared. Comparative Composition A and Composition B, according to the invention. The removal of tea stain was evaluated.

| | A | B |
|---|---|---|
| MGDA | 4.92 | 4.92 |
| Sodium carbonate | 3.33 | 1.78 |
| HEDP | 0.15 | 1.00 |
| Polymer (1) | 1.08 | 1.08 |
| Sodium disilicate (2) | 0.72 | — |
| SKS-6 | — | 0.72 |
| Sodium percarbonate | 2.34 | 2.34 |
| MnTACN | 0.008 | 0.008 |
| TAED | — | 0.70 |
| Surfactant | 1.73 | 1.73 |
| Enzymes | 0.069 | 0.069 |

MGDA: trisodium salt of methylglycine-N,N-diacetic acid (1) Sokalan PA25CL (2) Amorphous sodium disilicate Britesil H20

Tea Cup Preparations

The following solutions were prepared:

Stock solution #1: dissolve 6.56 g $CaCl_2.2H_2O$ in 100 ml of demineralized water Stock solution #2: dissolve 3.80 g $MgSO4.7H_2O$ in 100 ml of demineralized water Stock solution #3: dissolve 6.72 g $NaHCO_3$ in 100 ml of demineralized water Synthetic hardness water: 50 ml of each of the stock solutions 1, 2 and 3 are put in a vessel with 7 liter of demineralized water and filled with additional demineralized water up to 10 liters. pH is adjusted to 7.5 with HCl or NaOH Iron stock solution: 5 g $Fe_2(SO_4)_3$ and 1 ml HCl (37%) are dissolved in demineralized water to 1 liter total volume 2×30 g of "Twinnings Assam" Loose leaf tea are weighed and transferred in 2 tea bags. 4 liters of the synthetic hardness water is put in a kettle. 0.2 ml of the Iron (III) solution are added in the kettle. Kettle is switched on and the tea solution is brought to boil. Once the tea solution is boiling, the kettle is switched off and the 2 tea bags are added. Tea is let to infuse for 5 minutes and then the tea bags are removed.

The tea cups are filled with 100 ml of tea solution. After 5 minutes, 20 ml of tea solution is removed. This is repeated 5x so that all tea gets removed from the tea cups. After 5 times removing 20 ml of tea solution, the remaining thin layer of tea solution at the bottom of the tea cups is also removed. This whole process is repeated a second time with freshly brewed tea solution.

Wash Test in Automatic Dishwasher

Miele GSL 50C R-zeit 2 (8 mM) KI 65 with 21 gpg water were used for the test.

The compositions were weighed in vials, which were put upside down at bottom of dishwashers at moment of opening of the dispensers. 50 g IKW ballast soil ("Recommendations for the Quality Assessment of the Cleaning Performance of Dishwasher Detergents (Part B, update 2015), SOFW-Journal vol 142, June 2016) was put at start of the wash cycle.

Evaluation of Tea Cleaning

After washing, the tea cups were taken out of the dishwashers and let to dry. The tea cups were then graded by visual inspection. Each cup is given a tea stain removal score in the range of 1 (=worst stain removal) to 10 (=best stain removal). Scores were given by comparison to reference tea cups with grades between 1-10. Average tea cups scores for each of the tea cup types across wash cycles were calculated.

Results

Tea Cup Cleaning Grades:

| | A | B |
|---|---|---|
| Tea cups | 3.3 | 8.8 |

Tea stain removal was better with the composition of the invention even although the composition of the invention has lower level of carbonate than the comparative composition.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An automatic dishwashing cleaning composition comprising:

a) from about 20% to about 40% by weight of the composition of methylglycinediacetic acid;

b) from about 2% to about 6% by weight of the composition of 1-hydroxyethane 1,1-diphosphonic acid;

c) from about 2% to about 6% by weight of a dispersant polymer comprising sulfonate monomers;

d) from about 2% to about 6% by weight of the composition of a crystalline silicate having the formula $Na_2Si_2O_5$, wherein the total amount of the methylglycinediacetic acid, hydroxyethane 1,1-diphosphonic acid, and dispersant polymer;

e) a bleaching system comprising from about 8% to about 30% by weight of the composition of sodium percarbonate; from about 0.001% to about 1% by weight of the composition of a bleach catalyst, and from about 0.5% to about 5% by weight of the composition of tetraacetylethylene diamine;

f) from about 0% to about 20% by weight of the composition of carbonate;

g) a granulate enzyme comprising sodium sulfate and an enzyme selected from the group consisting of amylase, protease and mixtures thereof in a weight ratio of sodium sulfate to enzyme of greater than 4:1.

2. A composition according to claim 1 wherein the bleach catalyst comprises a manganese catalyst.

3. A composition according to claim 1 further comprising non-ionic surfactant.

4. A composition according to claim 1 further comprising a cationic polymer wherein the cationic polymer comprises in copolymerized form from:

i. 60% to 99% by weight of the cationic polymer of at least one monoethylenically unsaturated polyalkylene oxide monomer of the formula I (monomer (A))

I

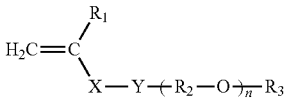

in which the variables have the following meanings:

X is —CH2- or —CO—, if Y is —O—;

X is —CO—, if Y is —NH—;

Y is —O— or —NH—;

R1 is hydrogen or methyl;

R2 are identical or different C2-C6-alkylene radicals;

R3 is H or C1-C4 alkyl;

n is an integer from 3 to 100, ii. from 1 to 40% by weight of the cationic polymer of at least one quaternized nitrogen-containing monomer, selected from the group consisting of at least one of the monomers of the formula IIa to IId (monomer (B))

IIa

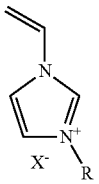

-continued

IIb

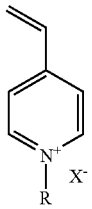

IIc

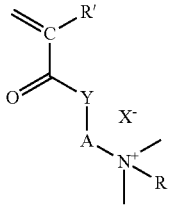

IId

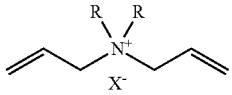

in which the variables have the following meanings:

R is C1-C4 alkyl or benzyl;

R' is hydrogen or methyl;

Y is —O— or —NH—;

A is C1-C6 alkylene;

X− is halide, C1-C4-alkyl sulfate, C1-C4-alkylsulfonate and C1-C4-alkyl carbonate.

iii. from 0 to 15% by weight of the cationic polymer of at least one anionic monoethylenically unsaturated monomer (monomer (C)), and iv. from 0 to 30% by weight of the cationic polymer of at least one other nonionic monoethylenically unsaturated monomer (monomer (D)), and the cationic polymer has a weight average molecular weight (Mw) from about 2,000 to about 500,000.

5. A water-soluble automatic dishwashing cleaning pouch comprising a water-soluble enveloping material and a composition according to claim 1.

6. A pouch according to claim 5 wherein at least part of the composition is in the form of loose powder.

7. A pouch according to claim 5 wherein the weight of the pouch is from about 15 to about 20 grams.

8. A composition according to claim 1, wherein the composition has from greater than 0% to less than about 2% of carbonate by weight of the composition.

9. A composition according to claim 1, wherein the granulate enzyme comprises the sodium sulfate and the enzyme in a weight ratio of 5:1 and 20:1.

10. A method of removing tea stains from tableware in a dishwasher comprising the steps of:

i) providing the stained tableware;

ii) treating the dishware with a wash liquor comprising water having from about 250 ppm to about 450 ppm of bicarbonate and a cleaning composition according to claim 1; and iii) optionally rinsing the dishware.

* * * * *